US007352258B2

(12) United States Patent
Andrews et al.

(10) Patent No.: US 7,352,258 B2
(45) Date of Patent: Apr. 1, 2008

(54) WAVEGUIDE ADAPTER FOR PROBE ASSEMBLY HAVING A DETACHABLE BIAS TEE

(75) Inventors: Mike Andrews, Cornelius, OR (US); Leonard Hayden, Beaverton, OR (US); John Martin, Portland, OR (US)

(73) Assignee: Cascade Microtech, Inc., Beaverton, OR (US)

( * ) Notice: Subject to any disclaimer, the term of this patent is extended or adjusted under 35 U.S.C. 154(b) by 0 days.

(21) Appl. No.: 10/283,632

(22) Filed: Oct. 29, 2002

(65) Prior Publication Data

US 2003/0184404 A1 Oct. 2, 2003

Related U.S. Application Data

(60) Provisional application No. 60/368,829, filed on Mar. 28, 2002.

(51) Int. Cl.
*H01P 5/103* (2006.01)

(52) U.S. Cl. ..... 333/26; 333/245

(58) Field of Classification Search ..... 333/26, 333/245

See application file for complete search history.

(56) References Cited

U.S. PATENT DOCUMENTS 4,063,195 A 12/1977 Abrams et al.
4,740,764 A * 4/1988 Gerlack ..... 333/26
5,148,131 A * 9/1992 Amboss et al. ..... 333/26
5,266,963 A 11/1993 Carter ..... 343/850
5,678,210 A * 10/1997 Hannah ..... 455/128
5,841,342 A 11/1998 Hegmann et al. ..... 333/995
5,970,429 A 10/1999 Martin ..... 702/65
6,549,106 B2 * 4/2003 Martin ..... 333/248

FOREIGN PATENT DOCUMENTS

JP 135804 * 5/1990 ..... 333/26

OTHER PUBLICATIONS

S.M. Joseph Liu and Gregory G. Boll, "A New Probe for W-band On-wafer Measurements," published 1993 IEEE MTT-S Digest, pp. 1335-1338.

"Air Coplanar Probe Series," published by Cascade Microtech in 1997, consisting of 6 pages.

"A Broadband Microwave Choke," by Piconics Inc. of Tyngsboro, MA, published Dec. 1999 in the*Microwave Journal*, consisting of pp. 141-142 and 144.

Agilent Technologies Test and Measurement web page for Product Information regarding "HP W281D Waveguide Adapter, 1 mm (m) to W-Band, 75 GHz to 100 GHz," 1994-2000, one page.

* cited by examiner

*Primary Examiner*—Benny Lee
(74) *Attorney, Agent, or Firm*—Chernoff, Vilhauer, McClung & Stenzel

(57) ABSTRACT

A probe assembly including a probe, a waveguide to transmission path transition, and a bias tee detachably connected to the probe.

14 Claims, 6 Drawing Sheets

WAVEGUIDE ADAPTER FOR PROBE ASSEMBLY HAVING A DETACHABLE BIAS TEE

This application claims the benefit of the U.S. Provisional Patent Application Ser. No. 60/368,829 filed Mar. 28, 2002.

BACKGROUND OF THE INVENTION

The present invention relates to a probe assembly for testing electrical devices such as silicon wafers, and more particularly to a high-frequency probe assembly having a bias tee.

High frequency testing of an electrical device-under-test (DUT) is usually accomplished by electrically connecting measurement equipment to a high frequency probe assembly that selectively probes contact points on the DUT. Existing probe assemblies include, for example, needle probes, and microwave probes.

Some measurement equipment is designed to be used repeatedly over time in conjunction with different types of probe assemblies. The measurement equipment, therefore, includes input and output ports for connectivity to the probe assembly. Because coaxial adapters have only recently been able to efficiently deliver signals above 65 GHz, frequently required for testing of today's high-frequency electrical circuits, wafer testing equipment may include ports that connect to a waveguide channel capable of delivering signals above 65 GHz.

Unlike waveguide channels, probes usually deliver a test signal to the DUT through needles. Coaxial cables may be used to provide a shielded test signal. Accordingly, it is not uncommon for a probe assembly to include a transition by which a test signal provided by the measurement equipment through a waveguide channel may transition to a coaxial line for use in testing a DUT.

A waveguide to coaxial transmission line transition typically comprises a waveguide channel into which the tip portion of a transmission line, such as the center conductor of a coaxial cable, may be inserted at a right angle to one of the interior surfaces of the waveguide channel. In a typical implementation a backshort having a reflective face is also included within the waveguide channel. The backshort is usually made of brass or some other reflective material, and is oriented perpendicular to the waveguide channel so as to reflect any alternating signal present within the waveguide channel towards the transmission line. The backshort is preferably located close to the transmission line. If properly positioned, the backshort will reflect the alternating signal within the waveguide into a standing wave pattern so that the alternating signal transitions to the transmission line with minimal signal degradation.

The position of the backshort relative to the center conductor of the coaxial cable should be adjusted to optimized performance in the primary band of the alternating signals present within the waveguide channel. Tuning of the transition is often difficult. At high frequencies, very small deviations from an optimal backshort position may lead to significant signal degradation.

Currently accepted practice is to tune the bias tee by adjusting the transition of the backshort by hand. Traditionally, a backshort that is constructed with a necked-down portion having low tensile strength that can be used as a handle. Conductive epoxy is applied around the perimeter of the backshort, which is then inserted into the waveguide channel. Adjustment of the backshort position within the waveguide channel is accomplished manually. Once the desired location of the backshort is obtained, the epoxy is cured by placing the bias tee in a heater. The handle is broken off and removed from the backshort.

A bias tee is a commonly used element to add a bias offset to the alternating signal within a transmission line, when desired. The bias offset is typically added to the alternating signal by wiring a DC source to the center conductor of a coaxial cable. The DC source may be a voltage source or a current source, as appropriate. Usually the DC signal passes through an inductor so that any alternating signal induced in the coaxial cable is generally isolated from the DC source. The bias tee may be incorporated together with the transition to provide a DC bias offset to the high frequency signal in the coaxial transmission line.

The bias tee and transition assembly may be interconnected with a probe, thereby creating a probe assembly, for testing devices. Existing probe assemblies integrate the bias tee with the probe; that is to say that the bias tee is permanently affixed to the probe. Unlike measurement equipment, however, a particular probe and waveguide assembly is not designed to be used repeatedly on successive types of DUTs, especially with different frequency ranges. Rather, a probe and waveguide combination is specially designed to test multiple copies of a single type of a DUT within a particular frequency range. Also, probes are contacting elements and eventually wear out after a number of uses. Because existing probe assemblies integrate the bias tee within the probe assembly, and because they are typically used for a single type of measurement for a particular DUT, the entire assembly is also discarded with the worn or outdated probe. Because of the aforementioned requisite manual tuning and precise positioning of the backshort, repetitive construction and tuning of bias tees is time consuming.

What is desired, therefore, is an assembly that includes a bias tee and transition that may be reused.

BRIEF SUMMARY OF THE INVENTION

The following presents a simplified summary of the disclosed system, apparatus or method in order to provide a basic understanding of some of its aspects. This summary is not an extensive overview and is intended to neither identify key or critical elements or delineate a scope of the disclosed system, apparatus or method. The sole purpose of this summary is to present some concepts in simplified form as a prelude to the more detailed description that is presented later.

A probe assembly comprises a probe, a waveguide to transmission path transition and a bias tee where at least one of the waveguide to transmission path transition and the bias tee is detachably connected to the probe.

DETAILED DESCRIPTION OF THE PREFERRED EMBODIMENT

Figure 1:
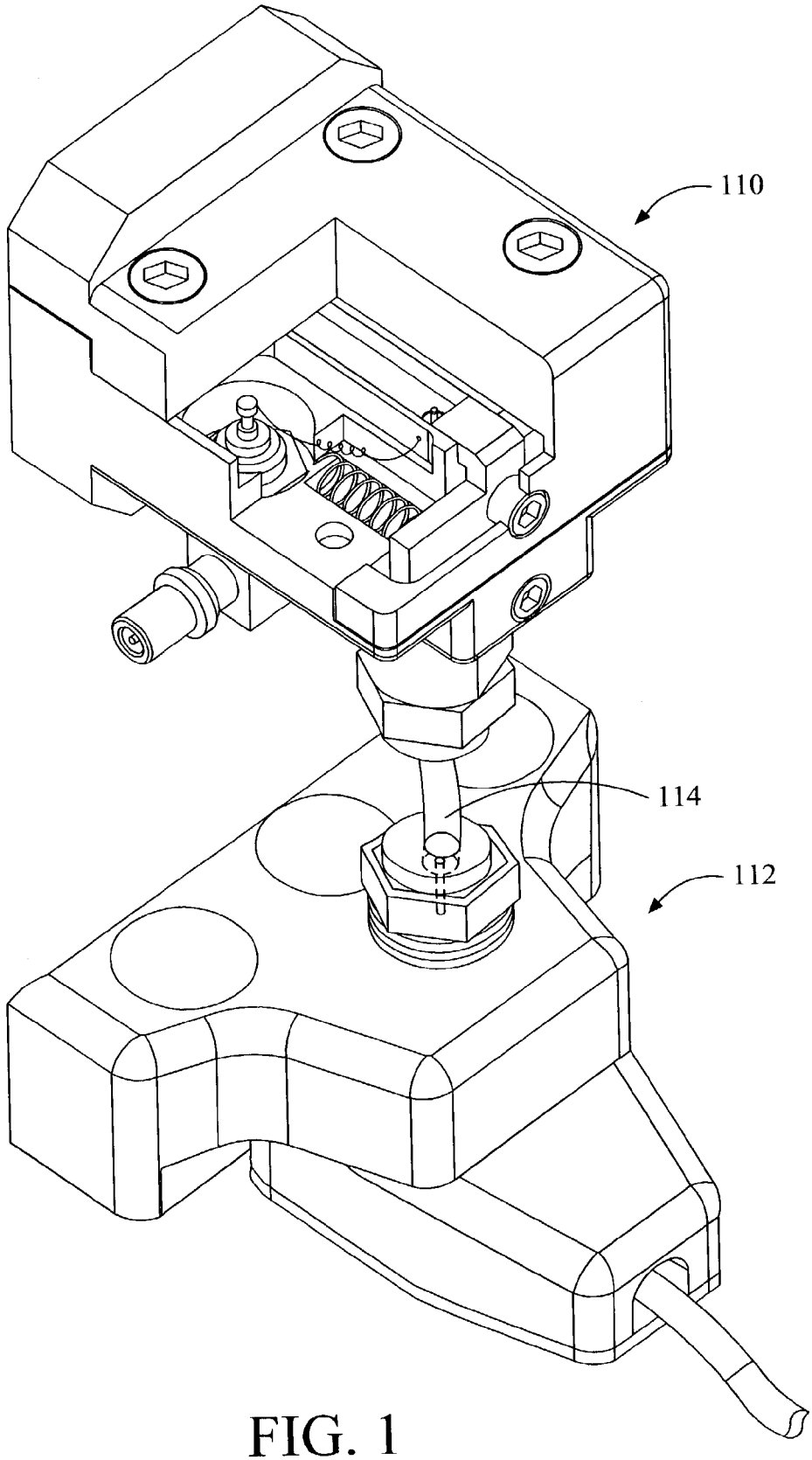
FIG. 1 shows an exemplary portion of a probe assembly that incorporates the present invention, depicting a transition with a bias tee detachably connected to a probe.

Referring to FIG. 1, one embodiment of a probe assembly comprises a bias tee and a transition 110 detachably connected to a probe 112 through a coaxial cable 114. It is to be understood that the probe assembly may include any probe, any transition, and any bias tee. Also, other connectors and transition paths may be used to provide a detachable interconnection between the transition bias tee 110 and the probe 112, together with the passage of a signal from the transition bias tee 110 to the probe 112.

Figure 2:
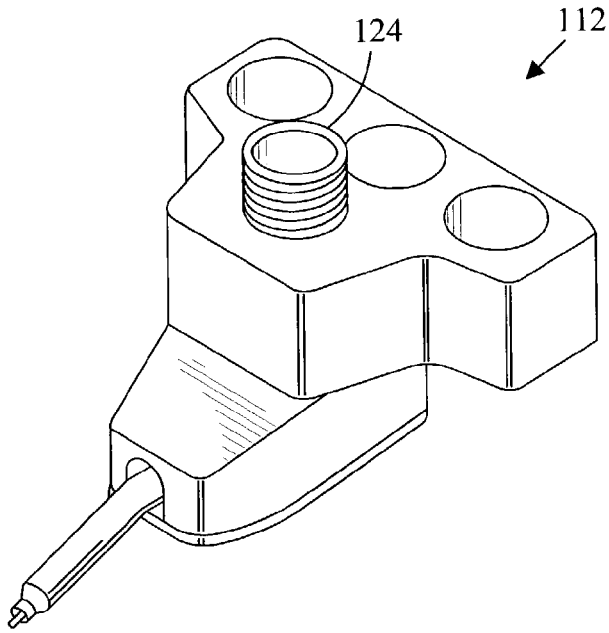
FIG. 2 shows an isometric view of the probe depicted in FIG. 1.
Figure 3:
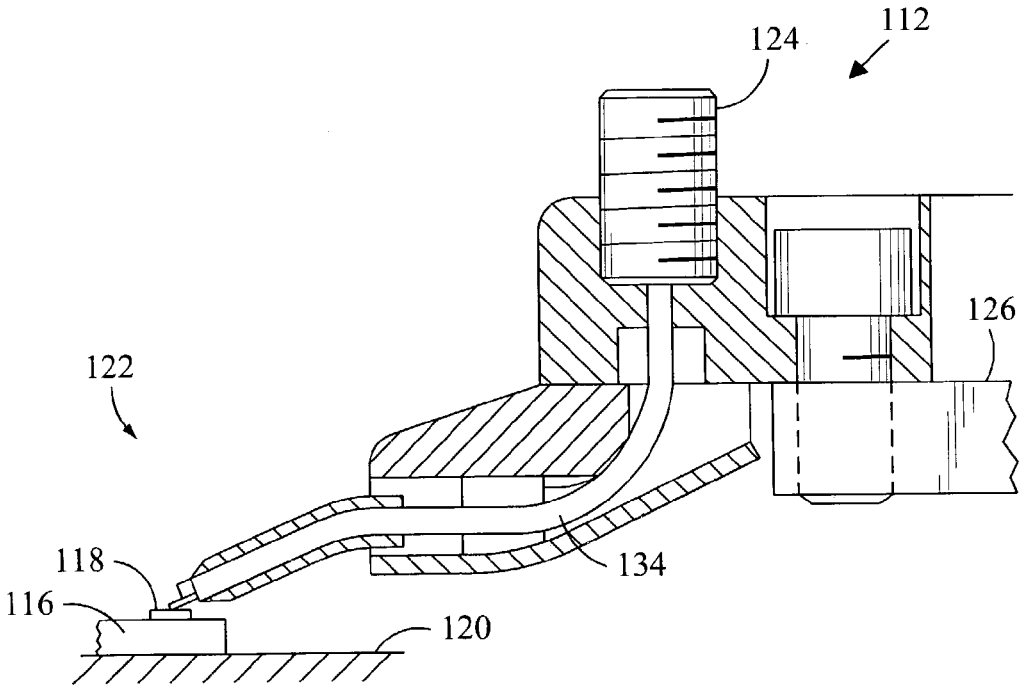
FIG. 3 shows a cross-sectional view of the probe depicted in FIG. 2 taken along the probes longitudinal centerline.

FIG. 2 shows an exemplary probe 112 that may be used. Referring also to FIG. 3, the probe 112 is designed to be mounted on a probe-supporting member 126 of a wafer probe station so as to be in a suitable position for probing a DUT, such as an individual component or pad on a wafer 116. In this type of application, the wafer is typically supported under vacuum pressure on the upper surface of a chuck 120.

Ordinarily, an x-y-z positioning mechanism such as a micrometer knob assembly is provided to effect movement between the probe supporting member 126 and the chuck 120 so that the tip assembly 122 of the probe 112 can be brought into pressing engagement with the contact pads 118 on the wafer that correspond to the particular component requiring measurement.

As shown in FIGS. 2-3, the exemplary wafer probe 112 has an input port 124 that, in the preferred embodiment depicted, comprises a coaxial connector. The coaxial connector 124 enables the detachable connection of the coaxial cable 114 that may interconnect the wafer probe 112 with the transition bias tee 110.

Figure 4:
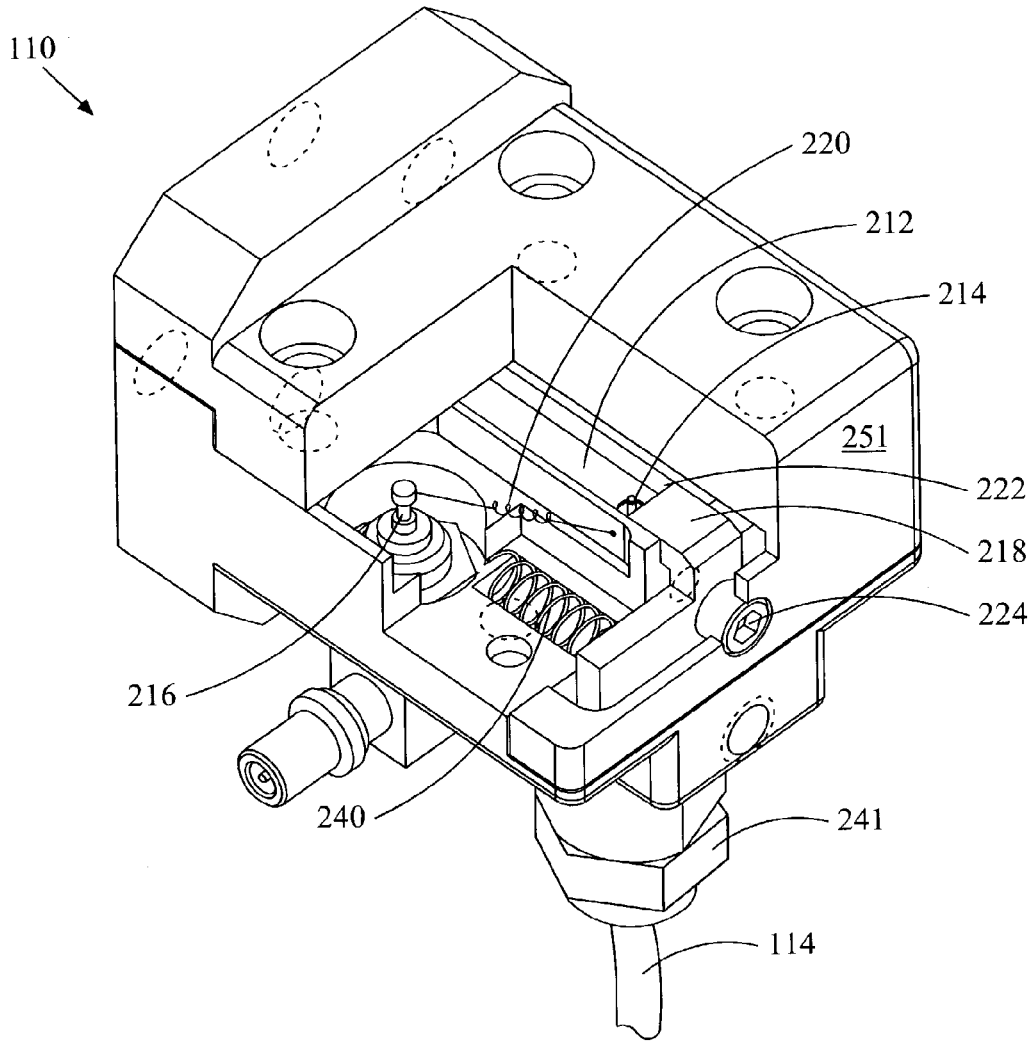
FIG. 4 shows an exemplary embodiment of a bias tee that includes an adjustable backshort, a body portion, and a cap portion.
Figure 4:
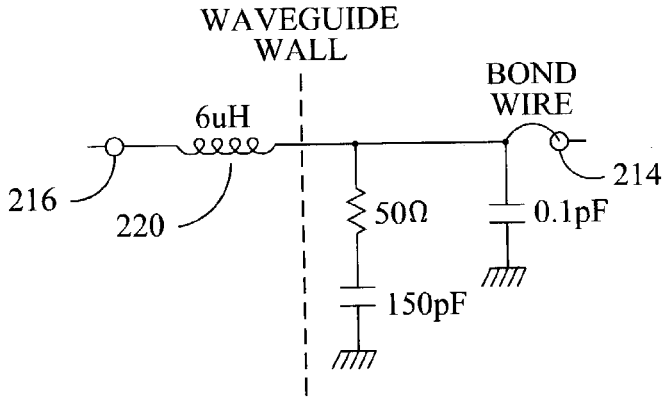

FIG. 4 shows an exemplary transition bias tee 110 that may be used in conjunction with the present invention. The transition bias tee 110 allows a test signal to transition from a waveguide 212 to a transmission line 214. The transition bias tee 110 thus permits the electrical interconnection of testing equipment, which provides an alternating test signal through a waveguide, to a probe 112 (FIG. 1), which is designed to receive a test signal through a coaxial cable. The transition bias tee 110 also permits a DC offset voltage or current to be selectively added to the test signal through a connector 216 that electrically connects a DC power source to the transmission line 214. In the preferred embodiment, the transmission line 214 is a coaxial cable depicted in FIG. 1. Similarly, a number of connectors will appropriately provide the DC offset, but for illustrative purposes, the preferred embodiment depicts a right angle SSMC connector.

As shown in FIG. 4, a portion of the coaxial cable 214, including the center conductor, protrudes into the waveguide 212. A backshort member 218 with a reflecting face 222 is positioned at one end of the waveguide 212. The backshort member 218 reflects any alternating signal present within the waveguide towards the center pin, thereby inducing within the coaxial cable 214 an alternating electrical signal desirably having approximately the same amplitude and frequency as that present within the waveguide 212. A DC component may be selectively routed to the coaxial cable 214 from the connector 216 thereby providing a DC offset to the induced alternating signal. Optionally, a bias circuit including a resistor and capacitor connected in shunt with a choke 220 may electrically interconnect the connector 216 and the coaxial cable 214 to prevent the induced alternating signal from being transmitted through the connector 216. A number of chokes are commercially available to perform this task, such as a conical choke.

As also shown in FIG. 4, the transition bias tee 110 includes an output port 241 to which the coaxial cable 114 may be attached. In the preferred embodiment depicted, the output port 241 comprises a coaxial connector. Referring as well to FIGS. 2 and 3, attachment of the coaxial cable 114 to the coaxial connector 241 of the transition bias tee 110 and the coaxial connector 124 of the probe 112 permits a shielded transmission path to be established between the coaxial cable 214 that protrudes into the waveguide 212 of the transition bias tee 110 and the coaxial cable 134 (see FIG. 3) that terminates within the tip assembly 122 of the probe 112. Utilization of a coaxial connector 124 and a coaxial connector 241 as an output port of the transition bias tee 110 and an input port of the probe 112 permits the coaxial cable 114 to be selectively detached from either the probe 112 or the transition bias tee 110, or both, as desired. It is to be understood that other embodiments of the invention may include a coaxial cable 114 that is detachable from either the probe 112 or the transition bias tee 110, but not both.

The waveguide wall may be, for example, the surfaces of the waveguide 212. A value of 6 μH may be, for example, the inductance of the choke 220. Values of 50 ohms, 150 pF, and 1 pF may be the characteristics of the choke 20. As illustrated in FIG. 4, the bond wire may be, for example, the connection between the choke 220 and the cable 214.

Existing backshorts are designed to move in direct response to an input, such as hand pressure. Hand pressure does not ordinarily provide sufficient precision to be useful with the present invention. The inventors have determined that the desired precision may be achieved by operationally interposing an adjustment member 224 between the backshort 218 and any applied input. The adjustment member 224 receives an applied input, transforms it into an output that then controls the movement of the backshort 218. Preferably, the output of the adjustment member 224 is less unwieldy than the input so that the reflecting face 222 may be moved to an appropriate position within the waveguide 212 with much more precision than that obtainable by previous design.

In the preferred embodiment, a screw is used as the adjustment member 224. As shown in FIG. 4, the screw 224 allows a rotational input applied at the screw head to be transformed into a transversal output applied on the backshort member 218. This controllable adjustment of the position of the backshort 218 represents a dramatic improvement over existing designs in that the backshort 218 is capable of precise adjustment to obtain optimal tuning. Existing backshort mechanisms contained within waveguide transitions are either non-adjustable, or if adjustable, rely upon mere hand pressure to slide a backshort member along a waveguide channel. In the preferred embodiment, the adjustment member 224 allows the waveguide transition to be finely tuned, improving performance. Assuming, for example, that the adjustment member 224 is an 80 pitch screw and can be turned in 45 degree increments, a resolution of about 0.0016 inches may be achieved.

Further, the preferred embodiment obviates any need to place conductive epoxy within the waveguide channel. If, for example, a screw is used as an adjustment member 224, as described in the preferred embodiment, and it is desired that the backshort member 218 be permanently fixed in place, a thread-locking compound may be used on the screw 224. The thread locking compound is preferably applied outside of the waveguide channel 212, eliminating any potential for contamination of the waveguide channel 212. Alternately, the backshort member 218 need not be permanently positioned, but instead may be re-tuned.

Because backshort movement within the waveguide channel may be positioned in much smaller increments in a controlled manner using the present invention, there is a greatly reduced risk of damaging electrical components should the backshort member 218 be inadvertently pushed too far into the waveguide channel 212. Again using a screw as an illustrative adjustment member 224, should the backshort member 218 be moved further into the waveguide 212 than optimally desired, the direction of backshort travel may simply be reversed by turning the screw 224 in the opposite direction.

Though a screw is used to illustrate the manner in which the inclusion of an adjustment member 224 improves upon present design, a variety of other devices or objects may be equally suitable as adjustment members. Examples might include a switch-activated electric positioner, a rack and pinion system operated by a handle, or a piezo-electric actuator. Similarly, the manner in which the input to the adjustment member 224 is transformed may also vary. The adjustment member 224 may alter the nature of an applied input, the way the illustrative screw depicted in FIG. 4 converts a rotational input to a transversal output. Alternately, the adjustment member 224 may simply change the scale of an input, linearly or non-linearly, as would a gear and tooth assembly.

Figure 5:
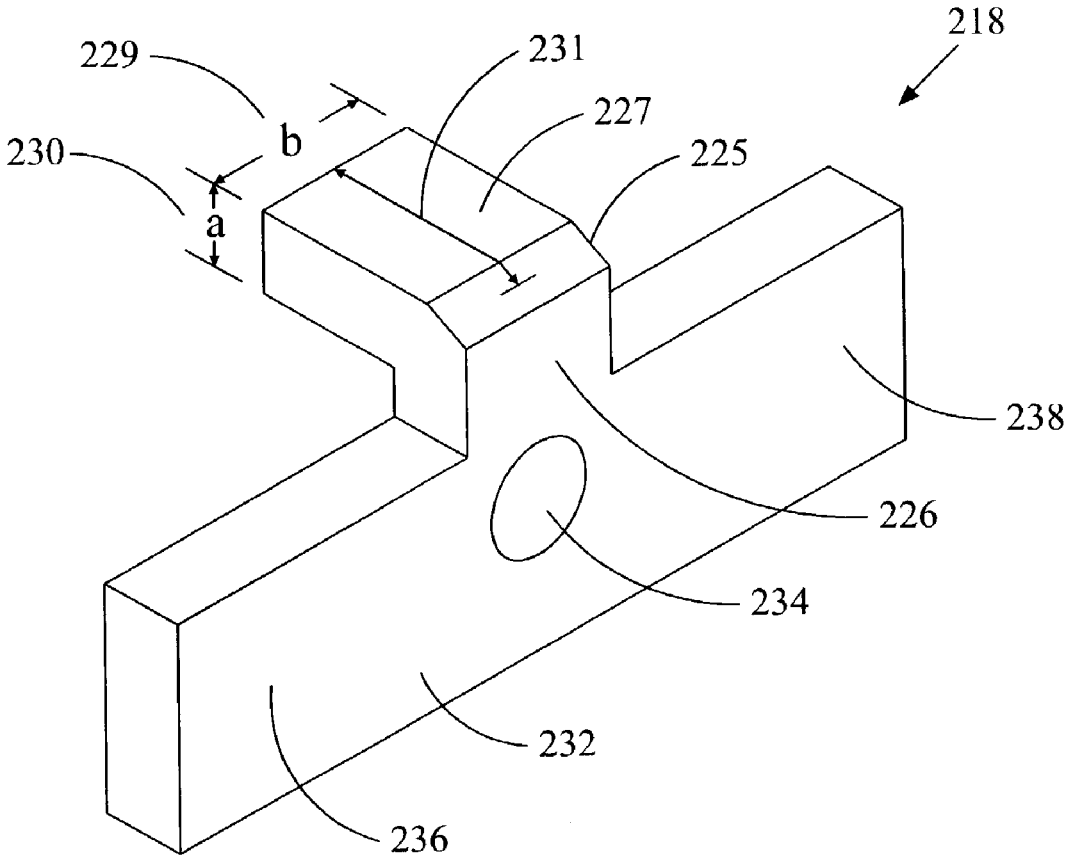
FIG. 5 shows the adjustable backshort of the bias tee of FIG. 1 at an enlarged scale.

Referring to FIG. 5, the backshort member 218 is preferably a unitary member, made from a casting, precision milling, or other process. In the preferred embodiment, the backshort member 218 includes a central elbow 226 having a supporting portion 225 and a cantilevered portion 227 oriented at substantially right angles to one another. The cantilevered portion 227 protrudes into the waveguide 212 and includes at its end a substantially planar reflecting face 222 oriented toward the coaxial cable 214.

The cantilevered portion 227 preferably has a width (b) 229 and a depth (a) 230 sized to fit securely within the waveguide 212 while retaining the ability to slide back and forth when the waveguide transition is being tuned. The cantilevered portion 227 has a length 231 measured from the supporting portion 225 preferably of sufficient length to permit the reflecting face 222 to closely approach the centerline of the coaxial cable 214. A stop (not shown) may be used to protect circuit components by limiting the movement of the backshort member 218 within the waveguide 212. The preferred embodiment has the exterior face of the transition enclosure 251 to within ⅜" inches of the axis of the coaxial cable 214, or closer (e.g., ⅜" or less) to permit a microscope objective lens to be positioned in line with the probe tips.

The backshort member 218 includes a base 232 from which the elbow 226 extends. The base 232 defines a hole 234 into which the screw 224 (FIG. 4) is engaged. The base 232 also includes two extensions 236 and 238 disposed laterally to either side of the hole 234. As shown in FIG. 4, a plurality of spring members 240 are located within the body of the transition bias tee 110 on either side of the waveguide 212 to apply an outwardly directed force to extensions 236 and 238, respectively. In the preferred embodiment, there are two such spring members 240. Turning the screw 224 in one direction moves the reflecting face 222 inwardly into the waveguide channel 212, compressing the spring members 240. When compressed, the spring members 240 provide the requisite force to push the reflecting face 222 in an outwardly direction when the screw 224 is turned in the opposite direction.

Because the preferred embodiment of the probe assembly includes a transition bias tee 110 having an adjustable backshort, an alternative probe assembly that incorporates the present invention could include a detachable transition bias tee without an adjustable backshort. In this embodiment, one bias tee for one frequency range could be detached from the assembly so that a second transition bias tee for another frequency range could be attached.

Figure 6:
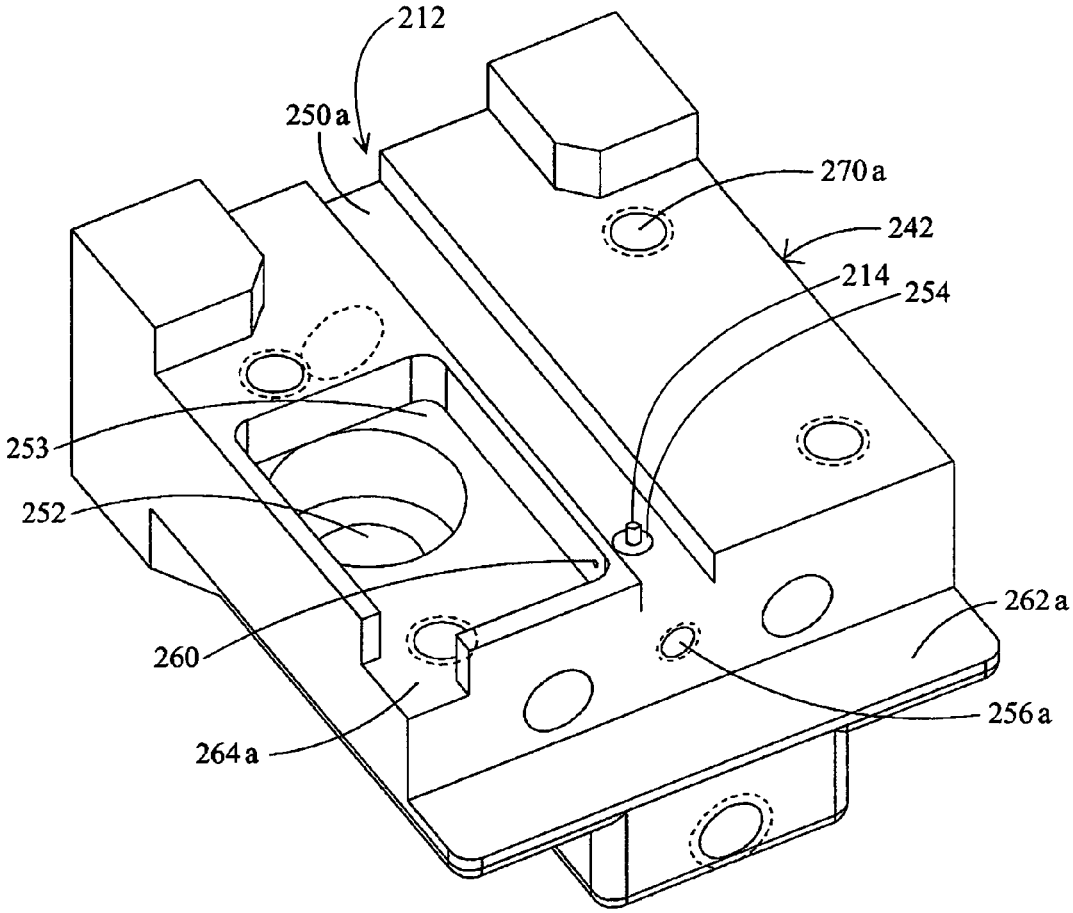
FIG. 6 shows the body portion of the bias tee of FIG. 1 at an enlarged scale.
Figure 7:
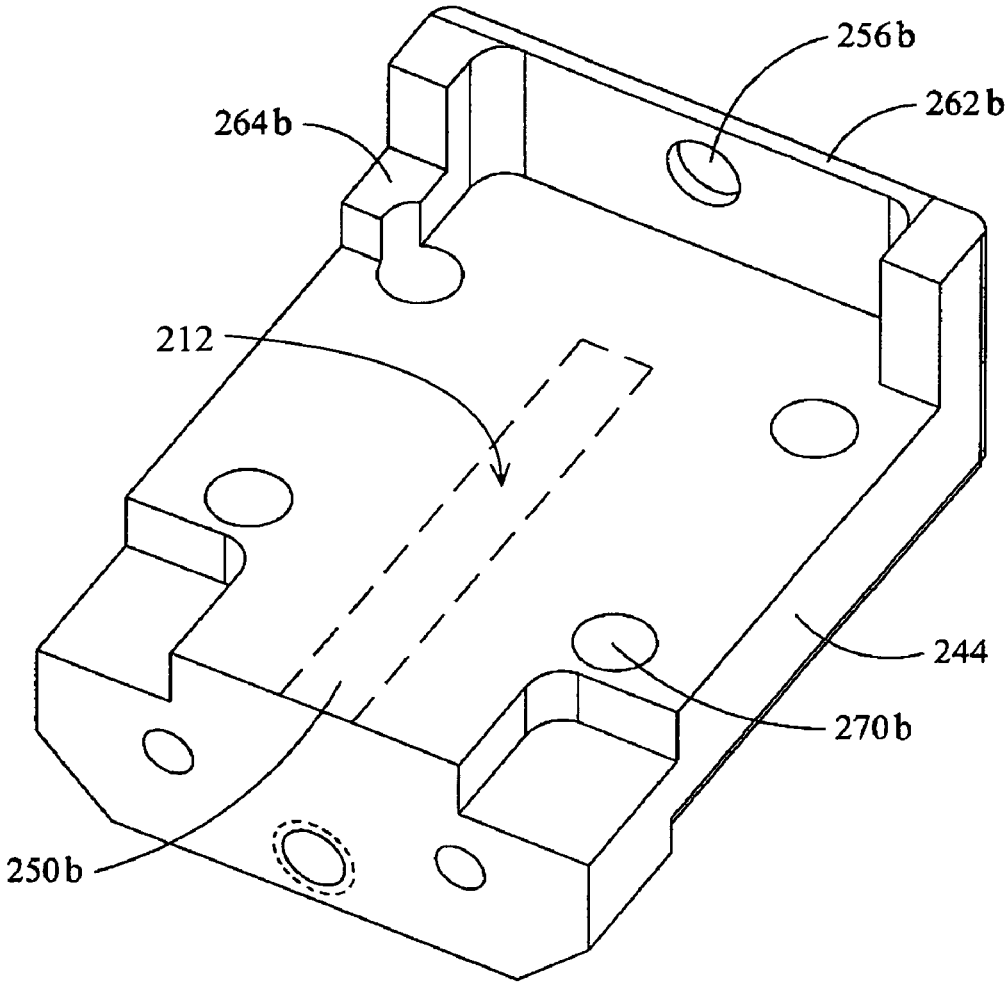
FIG. 7 shows the cap portion of the bias tee of FIG. 1 at an enlarged scale.

As shown in FIGS. 6 and 7, the transition bias tee 110 may be fashioned in two sections, namely, a bias tee body 242 (FIG. 6) and a bias tee cap 244 (FIG. 7). The bias tee body 242 (FIG. 6) and the bias tee cap 244 (FIG. 7) are designed to be engaged through a selective number of fastening cavities 270*a* (FIG. 6) and 270*b* (FIG. 7) contained in the bias tee body 242 (FIG. 6) and the bias tee cap 244 (FIG. 7), respectively.

The bias tee body 242 (FIG. 6) forms a lower waveguide surface 250*a* (FIG. 6) comprising three of the walls of the waveguide 212 (FIG. 6). The bias tee cap 244 (FIG. 7) forms a waveguide ceiling 250*b* (FIG. 7) that defines the fourth wall of the waveguide 212. The lower waveguide surface 250*a* (FIG. 6) and the waveguide ceiling 250*b* (FIG. 7) are preferably composed of a conductive material suitable for the transmission of electromagnetic waves at frequencies up to and above 65 GHz.

The bias tee body 242 (FIG. 6) also defines a coaxial cable port 254 (FIG. 6) within the lower wall of the lower waveguide channel surface 250*a* (FIG. 6). A SSMC port 252 (FIG. 6) contained within a cavity 253 (FIG. 6) facilitates the attachment of the SSMC connector 216, shown in FIG. 4, that may route a signal from a DC power supply (not shown) to the coaxial cable 214 fitted within the coaxial cable port 254. An opening 260 (FIG. 6) is defined by the side of the lower waveguide surface 250*a* (FIG. 6) to permit this connection. The SSMC cavity 253 (FIG. 6) preferably provides sufficient space so that, if desired, the choke 220, also depicted in FIG. 4, may be inserted between the SSMC connector 216 and the coaxial transmission line 214.

The bias tee body 242 (FIG. 6) includes a shelf portion 262*a* (FIG. 6), and the bias tee cap 244 (FIG. 7) includes a lip portion 262*b* (FIG. 7), both located at the side of the transition bias tee 110 with the backshort member 218. The shelf portion 262*a* (FIG. 6) of the bias tee body 242 (FIG. 6) and the lip portion 262*b* (FIG. 7) of the bias tee cap 244 (FIG. 7) are sized so that when the bias tee body 242 (FIG. 6) and the bias tee cap 244 (FIG. 7) are engaged, a space is provided within which the backshort member 218 may be fitted. To ensure this proper spacing, the preferred embodiment includes a spacer cavity 264*a* (FIG. 6) within the bias tee body 242 (FIG. 6) and a spacer 264*b* (FIG. 7) within the bias tee cap 244 (FIG. 7).

A threaded hole 256*a* (FIG. 6) is defined by the shelf portion 262*a* (FIG. 6) of the bias tee body 242 (FIG. 6) and a matching hole 256*b* (FIG. 7) is contained in the lip portion 262*b* (FIG. 7) of the bias tee cap 244 (FIG. 6) As can be seen in FIGS. 4, 6, and 7, when assembled, the screw 224 may be inserted into the hole 256b (FIG. 7) in the bias tee cap 244 (FIG. 7), through the backshort member 218 and into the threaded hole 256*a* (FIG. 6) in the bias tee body 242 (FIG. 6). In this fashion, the adjustable backshort member 218 may be readily tuned simply by turning the adjustment screw 224.

The terms and expressions employed in the foregoing specification are used therein as terms of description and not of limitation, and there is no intention in the use of such terms and expressions of excluding equivalents of the features shown and described or portions thereof, it being recognized that the scope of the invention is defined and limited only by the claims that follow.

The invention claimed is:

1. A probe assembly comprising, a probe, a waveguide to transmission path transition, and a bias tee, where at least one of said waveguide to transmission path transition and said bias tee is detachably connected to said probe.

2. A probe assembly comprising:

(a) a waveguide to transmission line transition with a bias tee having a first port for transmitting an electrical signal;

(b) a probe having a second port for receiving said electrical signal; and (c) a member that detachably interconnects said first port of said bias tee with said second port of said probe to pass said electrical signal between said transition and said probe.

3. The probe assembly of claim 2 where said member is a coaxial cable.

4. The probe assembly of claim 2 where said member is detachably connected to said first port of said transition.

5. The probe assembly of claim 2 where said member is detachably connected to said second port of said probe.

6. The probe assembly of claim 2 where said member is detachably connected to said first port of said transition and said second port of said probe.

7. The probe assembly of claim 2, said bias tee further comprising:

(a) waveguide;

(b) a backshort member movably engaged with said waveguide;

(c) an adjustment member operatively engaged with said backshort member so that an input to said adjustment member will produce an output of said adjustment member and displacement of said backshort member relative to said waveguide, at least one of a frequency, phase, and amplitude of said input differing from a respectively one of a corresponding frequency, phase and amplitude of said output of said adjustment member;

(d) a transmission line operably electrically connected with said waveguide so as to sense an alternating signal traveling within said waveguide; and (e) said transmission line is capable of receiving a DC offset bias.

8. The probe assembly of claim 7 said bias tee further comprising:

(a) said backshort member including a surface; and (b) said bias tee including at least one resiliently flexible member in pressing engagement with said surface.

9. The probe assembly of claim 7 wherein the bias tee includes a backshort member having a surface capable of reflecting said alternating signal traveling within said waveguide.

10. The probe assembly of claim 7 wherein said bias tee includes a screw as an adjustment member.

11. The probe assembly of claim 7 further comprising a DC signal provided to said transmission line.

12. An adapter comprising:

(a) a waveguide port to receive a first signal;

(b) a bias port to receive a second signal;

(c) a waveguide;

(d) a backshort member movably engaged with said waveguide, said backshort member including a surface;

(e) at least one resiliently flexible member in pressing engagement with said surface;

(f) an adjustment member operatively engaged with said backshort member so that an input to said adjustment member produces an output causing displacement of said backshort member relative to said waveguide, at least one of a phase, frequency and amplitude of said input differing from a respectively corresponding one of a phase, frequency and amplitude of said output of said adjustment member;

(g) a transmission line capable of receiving a DC offset bias and operably electrically connected with said waveguide so as to sense an alternating signal; and (h) a third port connected to said transmission line to provide said first and second electrical signals to a cable connected to said adapter at said third port.

13. The adapter of claim 12 wherein said backshort member includes a second surface capable of reflecting said alternating signal traveling within said waveguide.

14. The adapter of claim 12 wherein said adjustment member comprises a screw in engagement with said backshort member.

* * * * *

UNITED STATES PATENT AND TRADEMARK OFFICE

CERTIFICATE OF CORRECTION

PATENT NO. : 7,352,258 B2
APPLICATION NO. : 10/283632
DATED : April 1, 2008
INVENTOR(S) : Mike Andrews et al.

It is certified that error appears in the above-identified patent and that said Letters Patent is hereby corrected as shown below:

Col. 7, line 43
Change "respectively one" to --respective one--.

Signed and Sealed this

Twenty-eighth Day of October, 2008

JON W. DUDAS
*Director of the United States Patent and Trademark Office*